US006447673B1

(12) United States Patent
Cordera et al.

(10) Patent No.: US 6,447,673 B1
(45) Date of Patent: Sep. 10, 2002

(54) HYDROFINING PROCESS

(75) Inventors: Merry Holli Garrett Cordera; Charles Allen Comeaux; Koenraad Jacques Herrebout, all of Houston; Joe David Hunter, Friendswood, all of TX (US)

(73) Assignee: Fina Technology, Inc., Houston, TX (US)

( * ) Notice: Subject to any disclaimer, the term of this patent is extended or adjusted under 35 U.S.C. 154(b) by 8 days.

(21) Appl. No.: 09/803,781

(22) Filed: Mar. 12, 2001

(51) Int. Cl.[7] ..... C10G 45/00; C10G 47/04; C10G 45/06

(52) U.S. Cl. ..... 208/212; 208/204; 208/213; 208/214; 208/89; 208/110

(58) Field of Search ..... 208/212, 204, 208/213, 214, 89, 110

(56) References Cited

U.S. PATENT DOCUMENTS

| | | | | |
|---|---|---|---|---|
| 4,435,275 A | * | 3/1984 | Derr et al. | 104/217 |
| 4,786,404 A | | 11/1988 | Kemp | 208/217 |
| 5,001,101 A | | 3/1991 | Kemp | 208/211 |
| 5,006,224 A | | 4/1991 | Smegal et al. | 208/254 H |
| 5,198,099 A | | 3/1993 | Trachte et al. | 208/84 |
| 5,198,100 A | | 3/1993 | Aldridge et al. | 208/84 |
| 5,266,188 A | | 11/1993 | Kukes et al. | 208/216 R |
| 5,447,621 A | | 9/1995 | Hunter | 208/58 |
| 6,123,830 A | | 9/2000 | Gupta et al | 208/76 |

* cited by examiner

*Primary Examiner*—Thuan D. Dang
(74) *Attorney, Agent, or Firm*—William D. Jackson

(57) ABSTRACT

A hydrofining process in which a sulfur- and hydrocarbon-containing processing stream is supplied to a multi-stage hydrotreating reactor incorporating separate stages of cobalt molybdenum catalysts. Hydrogen may be supplied concurrently or counter-currently with the hydrocarbon-containing processing stream. The processing stream is passed into contact with an initial catalyst stage comprising a cobalt molybdenum desulfurization catalyst present in a minor amount of the total composite amount of catalysts within the reactor. Thereafter the processing stream is passed through a subsequent catalyst stage comprising a major amount of cobalt molybdenum hydrocracking catalyst. The effluent stream having a reduced sulfur content is then withdrawn from the hydrotreating reactor. The initial and subsequent catalyst stages are separated by an intervening sector within the reactor containing an inert particulate refractory material, specifically silica particles generally spheroidal in shape.

22 Claims, 5 Drawing Sheets

HYDROFINING PROCESS

FIELD OF THE INVENTION

This invention relates to the hydrofining of hydrocarbon streams and more particularly to the hydrofining of such streams employing multistage catalytic hydrofining for the reduction of sulfur contaminants in such streams.

BACKGROUND OF THE INVENTION

The hydrotreating of hydrocarbon streams over catalyst systems employing Group VI and Group VIII metals is well known in the chemical processing industry. Such hydrotreating of petroleum feedstocks, which can be derived from crude oil distillation units, cracking units, and other units involved in oil refining operations, typically involve a so-called hydrofining operation in which a hydrocarbon feedstock containing unwanted sulfur and nitrogen components as well as aromatic components are supplied along with hydrogen in order to effect desired contaminant reactions in the feedstock. In such operations, it is desired to effect hydrotreating and hydrodesulfurization reactions with the result that the sulfur and nitrogen content of the feedstock is substantially reduced and hydrogenation of various unsaturated hydrocarbon components in the feedstock e.g., the hydrogenation of aromatics, takes place. Typically the catalyst systems employed in such processes involve metals found in Group VI and Group VIII of the Periodic Table of the Elements. For example, U.S. Pat. No. 5,198,099 To Trachte discloses a so-called three-stage process for the refining of distillate streams. The first stage involves hydrotreating the feedstock at a temperature ranging from about 200°–400° C. and a hydrogen gas rate ranging from 4000–6000 SCF/barrel over a catalyst comprised of at least one Group VIII metal and a Group VI metal on an inorganic oxide support. Specifically disclosed among the Group VIII metals are cobalt and nickel. The preferred Group VI metal is molybdenum. Preferred supports are said to be alumina and silica-alumina with the former most preferred. The effluent from the first hydrotreating stage is supplied to a second hydrotreating stage conducted under milder conditions about 190° C. to 360° C. to remove additional sulfur and nitrogen while keeping cracking at a minimum. The heavier fractions output from the second stage is supplied to a third hydrocracking stage operated at a temperature of 200–370° C. The catalyst employed in the second and third stages is described as a conventional hydrocracking catalyst, typically a Group VIII catalyst on a zeolite cracking base.

U.S. Pat. No. 5,447,621 to Hunter discloses a refining process described as an integrated process involving a hydrocracking stage, a product fractionation stage, and a hydrotreating stage. Catalysts disclosed for use in the hydrotreating reactions, which are described as including aromatic hydrogenation, catalytic dewaxing, hydroprocessing hydrodenitrogenation, and hydrodesulfurization, include cobalt molybdenum and nickel molybdenum base metals or a noble metal catalyst. U.S. Pat. No. 6,123,830 to Gupta et al also discloses an integrated refining process which involves a hydroprocessing procedure which incorporates at least two hydrotreating steps and at least two catalytic cracking reactions, preferably performed in series. The hydroprocessing reactions typically are carried out over trickle bed reactors involving a concurrent downflow of liquid and gas phases over fixed catalyst beds. The catalyst employed are said to be suitable for aromatic saturation, desulfurization, or denitrogenation or combinations thereof and include at least one Group VIII metal and a Group VI metal on an inorganic refractory support. A preferred support is said to be alumina or alumina-silica. The silica-alumna supports include crystalline alumino-silicates such as zeolites. The Group VIII metals include cobalt, nickel, and iron, and the preferred Group VI metal is molybdenum.

Yet another process for the hydrotreating of process streams for the removal of heteroatoms incorporating sulfur from such streams is disclosed in U.S. Pat. No. 5,198,100 to Aldridge et al. The various feedstocks disclosed in Aldridge are light, middle, and heavy petroleum distillates, petroleum residual feeds, and coal-derived liquids, shale oil, and heavy oils from tar sands. The catalysts employed in the Aldridge et al process incorporate salts or complexes of at least one Group VIII metal, cobalt and/or nickel, with at least one Group VI metal heteropolyacid, preferably molybdenum or tungsten on an inorganic oxide support, preferable alumina. Supports for the Group VI and Group VIII supports can also include silica-alumina. After formulating the supported catalyst, the support can be impregnated with appropriate metal salts followed by a Group VIII heteropolyacid deposit on the support. The catalyst is then dried and prior to use is sulfided with a sulfur-containing distillate. This is followed by the hydrotreating procedure. The sulfiding feed can take the form of a 7.4 % dimethylsulfide and 92.6% of petroleum distillate.

SUMMARY OF THE INVENTION

In accordance with the present invention there is provided a multi-stage hydrofining process incorporating separate stages of cobalt molybdenum catalysts. In carrying out the invention, a sulfur- and hydrocarbon-containing processing stream is supplied to a multi stage hydrotreating reactor. The reactor is operated under conditions effective to accomplish the hydrofining reactions in the presence of hydrogen which may be supplied concurrently or countercurrently with the hydrocarbon-containing processing stream. Within the reactor, the processing stream is passed initially into contact with an initial catalyst stage comprising a cobalt molybdenum desulfurization catalyst. This catalyst is present in a minor amount preferably an amount within the rage of 10–40% of the total composite amount of catalysts within the reactor. Thereafter the processing stream is passed through a subsequent catalyst stage comprising a major amount of a cobalt molybdenum hydrocracking catalyst. Preferably, the cobalt molybdenum catalyst in the subsequent catalyst stage comprises from about 60–90% of the composite of the cobalt molybdenum catalysts. The effluent stream having a reduced sulfur content is then withdrawn from the hydrotreating reactor where it can be made available for further processing.

Preferably, the initial and subsequent catalyst stages within the reactor are separated by an intervening sector which occupies a relatively small section within the reactor, thus providing a travel path in the reactor which is less than the travel path of the initial catalyst stage. This intervening sector contains an inert particulate refractory material of low thermal conductivity. In a particularly preferred embodiment of the invention the intervening particulate material comprises silica particles which are generally spheroidal in shape.

In the preferred embodiment of the invention, the cobalt molybdenum catalyst employed in the initial catalyst stage is supported on an alumina support and the cobalt molybdenum catalyst in the subsequent catalyst stage is supported on a silica-alumina support having a greater acidity than the alumina support for the initial cobalt molybdenum catalyst.

Preferably, the cobalt molybdenum catalyst in the initial stage comprises about 10–30 wt. %, more preferably 10–20 wt. %, of the total composite catalysts, and the catalyst in the subsequent stage, about 70–90 wt.%, more preferably 80–90 wt. %, of the total composite amount of the catalysts within the reactor.

DETAILED DESCRIPTION OF THE INVENTION

The present invention can be carried out in the hydrofining of various sulfur-contaminated feedstocks such as disclosed in the aforementioned patents to Trachte, Hunter, Gupta, and Aldridge. However, a preferred application of the present invention is in the operation of distillate hydrotreaters where the feed stocks are generally in the middle distillate ranges. A distillate hydrotreating stage normally involves two or more series-connected distillate hydrotreaters which treat distillate cuts such as light distillate, atmospheric gas oil, straight-run diesel fuels, and the like recovered from the distillation columns of a crude oil refining unit. Other feed stocks include light cycle gas oil, such as may be recycled from fluid catalytic cracking (FCC) units. In general, the processing streams to which the invention is particularly applicable can be described as having an initial (5 vol. %) boiling point and a final (95 vol. %) boiling point within the range of 200°–500° C. and more likely within the range of about 220°–470° C.. However, the initial boiling point can be lower, 160° C., in the case of straight-run diesel oil. Such feed stocks typically can contain a sulfur content of up to about 2 wt. %, primarily present as thiohydrocarbons, and a nitrogen content of up to about 0.1 wt. %. By the application of the present invention, the nitrogen content and the sulfur content present in heteroorganic compounds can be substantially reduced by values of up to 95% and even above at weighted average bed temperatures (WABT) for the reactor of about 400° C. ranging down to about 375° or even less.

Figure 1:
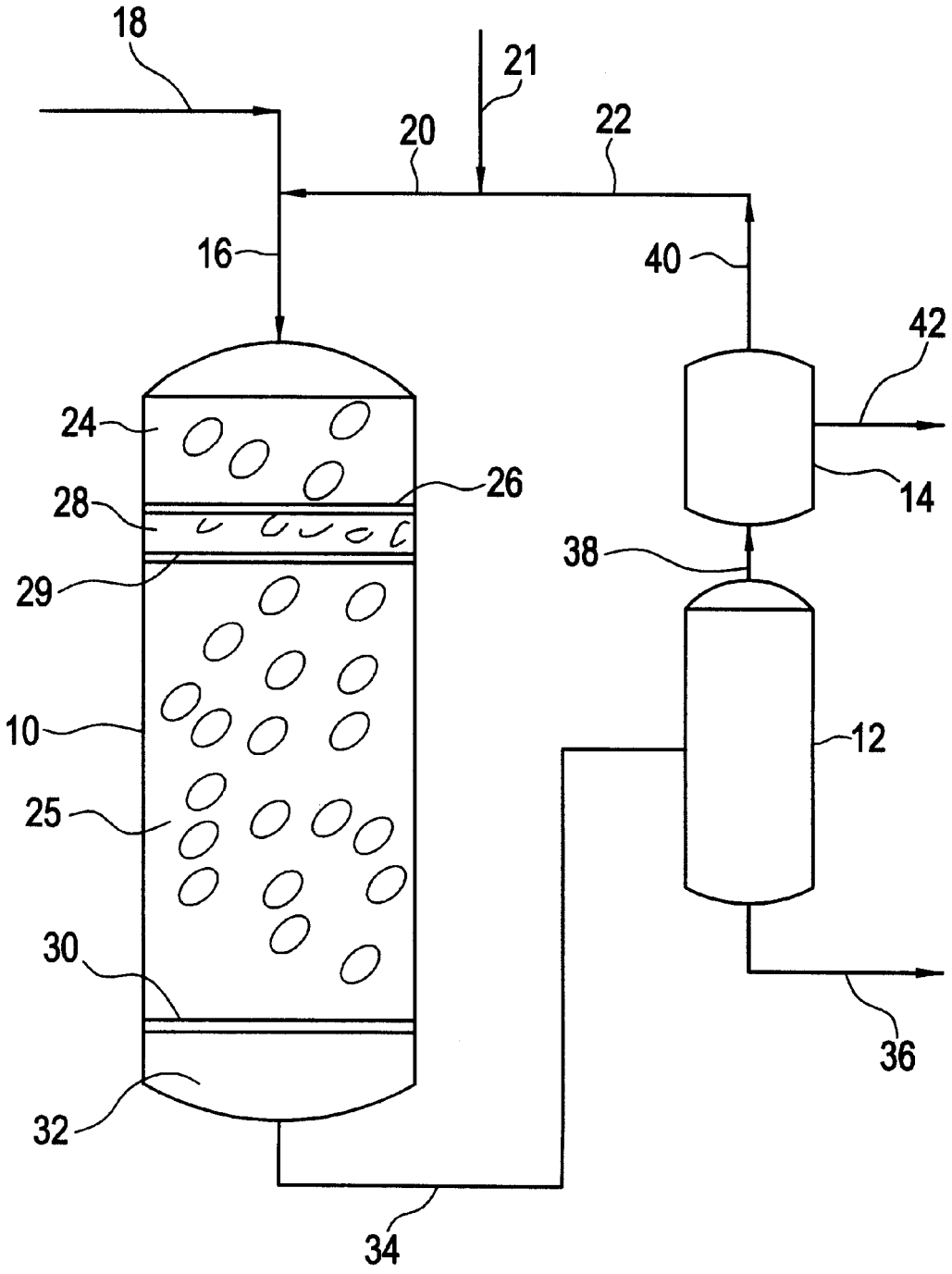
FIG. 1 is a schematic illustration of a distillate hydrotreating system incorporating a two-stage hydrotreater.

Turning now to the drawings and referring initially to FIG. 1, there is illustrated a distillate hydrotreating system incorporates a hydrotreater provided with two catalyst stages which is suitable for carrying out the present invention. The hydrotreating system of FIG. 1 comprises a distillate hydrotreater 10, an outlet liquid-gas separator 12, and a second stage gas separator 14 for separating hydrogen sulfide and hydrogen recovered from the top of the separator 12. The hydrotreater 10 typically can take the form of the second hydrotreater of a two-stage distillate hydrotreating system which treats the output from a crude distillation unit, although it will be recognized that hydrotreaters employed in carrying out the present invention can be located at various stages of a petroleum refining operation.

Referring further to FIG. 1, the inlet line 16 to the hydrotreater is supplied with a middle distillate sulfur-containing hydrocarbon stream 18, such as kerosene, diesel oil fraction, and atmospheric gas oil fraction or the like. A hydrogen stream 20 is supplied to inlet line 16 from a hydrogen supply line 21 and a hydrogen recycle line 22. While reactor 10 provides for concurrent flow of hydrocarbon stream and the hydrogenation gas, it will be recognized the various other reactor set-ups may be employed, including trickle-down reactors in which hydrogen gas is provided separately to the reactor in a countercurrent flow relationship. The hydrogen gas will be supplied to the input of the hydrotreater in any suitable amount depending upon the feed characteristics and the design operating temperature of the hydrotreater. Normally the hydrogen gas will be supplied in an amount within the range of about 1500–2600 standard cubic feet (SCF) per barrel of sulfur-containing processing feed stream. The reactor comprises an initial catalyst stage 24 and a subsequent catalyst stage 25 which is separated by an intermediate inert stage 26 comprised of a particulate refractory material of a relatively high thermal capacity. The initial catalyst stage 24 is formed of a particulate cobalt molybdenum desulfurization catalyst which is effective in the reactor to remove the sulfur, present as principally thiohydrocarbons, in an exothermic reaction resulting in the production of hydrogen sulfide. The desulfurization catalyst preferably is characterized in terms of relative amounts of cobalt and molybdenum in which cobalt is the minor component and molybdenum, the major component. This may be contrasted with the hydrocracking catalyst described below in which the molybdenum is the major component and cobalt, the minor component, with the sum of both components being less than the sum of these components in the desulfurization catalyst. Specifically, with respect to the preferred desulfurization catalyst described below, the ratio of molybdenum to cobalt in the initial desulfurization catalyst is about 6:1. This ratio is lower in the hydrocracking catalyst, and here the ratio of molybdenum to cobalt in the hydrocracking catalyst is about 5:1. The catalyst incorporated in the initial stage 24 is preferably one containing about 4 wt. % cobalt and 24 wt. % molybdenum on an alumna support. The catalyst may take the form of a catalyst commercially available from Akzo Nobel Catalysts LLC under the designation KF-757. This catalyst preferably is treated with an initial presulfiding step of the type disclosed generally in the aforementioned patent to Aldridge et al. Specifically, the catalyst is presulfided with dimethyl disulfide. The dimethyl disulfide maybe incorporated into a middle distillate carrier such as straight-run diesel in an amount of 2% dimethyl disulfide. The catalyst 24 is supported within the reactor on suitable perforated or screen-type grid plate system 25.

Immediately below the catalyst bed 24 is a relatively thin intervening accumulation of refractory material 28. The refractor material may be supported on a perforated plate, screen or grid 29 as shown. Alternatively, element 29 may be eliminated and the refractory material supported directly on the lower catalyst bed. The refractory material provides for separation between the upper and lower catalyst beds and is also a relatively high heat capacity to provide for smooth transition as the feedstream flows from the first catalyst bed where the reaction is highly exothermic to the second catalyst bed where the mild hydrocracking and further desulfurization action is less exothermic or even endothermic. The second catalyst bed 25 is supported on a perforated support 30 which provides for a lower exhaust plenum 32.

Preferably, the particulate refractory material 28 comprises silica particles which are generally spheroidal in shape. However, other refractory materials may be employed in carrying out the invention. Such refractory materials are well known to those skilled in the art and include alpha alumina particles of a fluted ring shape and nickel molybdenum alumina particles which may be ring-shaped or in the form of a quadralobe configuration having a high void content. Other suitable refractory materials include magnesium aluminate ($MgAl_2O_4$), particles which are in the form of generally circular tablets with radial elongated openings which provide high void fractions.

The desulfurized effluent from the reactor is withdrawn via line 34 and passed to the multistage separation zones 12 and 14. In the initial separation stage 12, desulfurized and denitrogenized product is withdrawn via line 36 and passed to a system (not shown) within the refinery for further processing. For example, the desulfurized and denitrogenized product is withdrawn via line 36 to a suitable separation system (not shown) for fractionation of the product into suitable products such as diesel oil or naptha fractions or a distillate fraction for further processing in a fluid catalytic cracking unit. The lighter gas component is passed via line 38 to gas separator 14. The gas separator 14 functions to separate the relatively dense hydrogen sulfide from the molecular hydrogen in the product stream with the hydrogen being recycled via line 40 to the reactor 10 and the hydrogen sulfide withdrawn via line 42 for further processing.

As noted previously, the temperature is not uniform throughout the reactor because of the highly exothermic nature of the desulfurization reaction, and accordingly, the reactor temperature is characterized in terms of the weighed average bed temperature (WABT). The WABT is defined in terms of the inlet temperature and the higher outlet temperature in accordance with the following equation:

$$WABT = \text{inlet temperature} + \tfrac{2}{3}(\text{outlet temperature} - \text{inlet temperature})$$

As indicated by the experimental data set forth below, the effectiveness of the process in removing sulfur is temperature-dependent with the maximum hydrodesulfurization occurring at reactor temperatures (WABT) which progressively increase to a value of about 380–385° C., at which point it tends to plateau, with further increases in temperature resulting in little or no increase in desulfurization activity. Preferably, the reactor is operated at a WABT within the range of 370–385° C. in order to achieve a relatively high desulfurization rate of about 94% and preferably 95% or more. Temperatures in excess of about 385° C. can be employed but are generally not energy-efficient in terms of sulfur removal. The minimum sulfur content of product occurs at temperatures of about 400° C., and this will usually be considered an upper limit for the reactor operation.

FIGS. 2–7 illustrate experimental results obtained for desulfurization tests carried out employing the two preferred catalysts identified herein as Catalysts A and B. Catalyst A is available from Akzo Nobel Catalysts LLC under the designation KF-757, and this catalyst, as indicated earlier, is a cobalt molybdenum catalyst comprising about 4% cobalt, about 24% molybdenum, and 2% phosphorous on an alumina support. Specifically, the alumina support is particulate alumina comprising about 70 wt. % of the total composite of the cobalt molybdenum catalyst. This catalyst is a highly effective hydrodesulfurization catalyst resulting in efficient removal of sulfur and nitrogen from organic compounds by an exothermic reaction.

The catalyst (Catalyst B) employed in the second stage of the reactor is a cobalt molybdenum catalyst on a silica-alumina-boron support which has some desulfurization activity and also some mild hydrocracking activity. Here, the cobalt and molybdenum components are present in amounts of about 3% and 15%, respectively, with the silica, alumina, and boron support comprising about 82 wt. % of the total amount of the catalyst. The silica-alumina-boron support has a relatively high acidity and is substantially more acidic than the alumina support of Catalyst A. Catalyst B is available from Akzo Nobel Catalysts LLC under the designation KF-1022.

Figure 2:
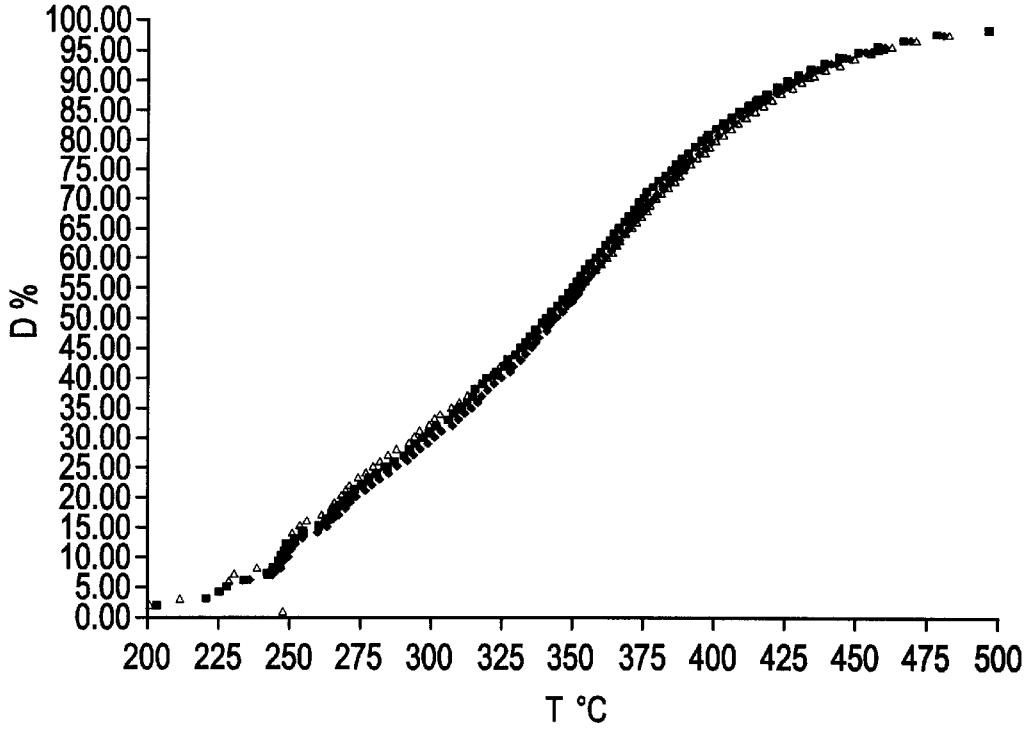
FIG. 2 is a composite distillation curve for feeds employed in experimental work respecting the invention.

In experimental work carried out respecting the invention, hydrodesulfurization activity of various mixtures of the catalysts denominated above as Catalyst A and Catalyst B was determined by tests carried out on feedstocks comprising distillate fractions characterized as atmospheric gas oil (AGO), light cycle oil (LCO), and a blend of the atmospheric gas oil and light cycle oil. FIG. 2 illustrates the distillation curves of the blend of the atmospheric gas oil and light cycle oil plotted as volume percent distillate D as a function of temperature T in °C. FIG. 2 illustrates the distillation curves of the blend used for the various catalyst systems involving 40% Catalyst A and 60% Catalyst B Δ, 20% Catalyst A and 80% Catalyst B (the preferred relative catalyst formulation) ■, and 100% of the cobalt molybdenum catalyst (Catalyst B) ♦, i.e. without an initial cobalt molybdenum desulfurization stage. From an examination of FIG. 2, it can be seen that the feeds for several test procedures involve consistent boiling point curves characteristics with the 5% boiling point occurring at approximately 218° C. and the 95% boiling point at about 454° C.

TABLE 1

| Feed Analysis (number) | AGO | LCO | F2 |
|---|---|---|---|
| Density at 60° F. | 0.8947 | 0.9775 | 0.9327 |
| Sulfur content, wt % | 1.771 | 1.997 | 1.78953 |
| Sulfur content, ppm | 17708.6 | 19968.4 | 17895.3 |
| N ppm | | | 851 |
| Aniline Point, F | | | 130.3 |
| Ni, ppm | | | 0.12 |
| V, ppm | | | 0.04 |
| Pour Point, C | | | 12 |
| PNA Total | | | 19.7 |
| MCRT % | | | 28.74 |

Table 1 shows the feed analysis of the atmospheric gas oil, the light cycle oil, and the blend of these two distillates, with the amount of sulfur in these different fractions being indicated.

In the experimental work, the catalyst was presulfided with dimethyl disulfide, and the tests were carried over at the various catalyst configurations with a feed blend of 43 vol. % light cycle oil and 57 vol. % atmospheric gas oil. In the experimental work, the laboratory reactor was pressurized to a pressure of 600 psi at room temperature. Initially, fluid flow to the reactor was conducted in an upflow mode in order to ensure that the catalyst particles were completely wetted. Once in this mode, straight-run diesel oil was pumped into the reactor at a rate of 2.0 $hr^{-1}$ liquid hourly space velocity (LHSV) until liquid was observed to exit from the top of the reactor, thus assuring that the catalyst within the reactor was completely wetted. The unit was then set for down flow operation, and a presulfiding stream comprising straight-run diesel containing 2% DMDS was pumped into the reactor at 1.81 hr.$^{-1}$LHSV. The presulfiding procedure was carried out at by ramping up the temperature to 290° C. at a rate of 25° C. per hour and the temperature then held at 290° C. for nine hours. The temperature was then increased to 310° C. at a rate of 10° C. per hour and the temperature then held constant at 310° C. for two hours. At this stage, presulfiding of the catalyst was considered to be complete.

Figure 3:
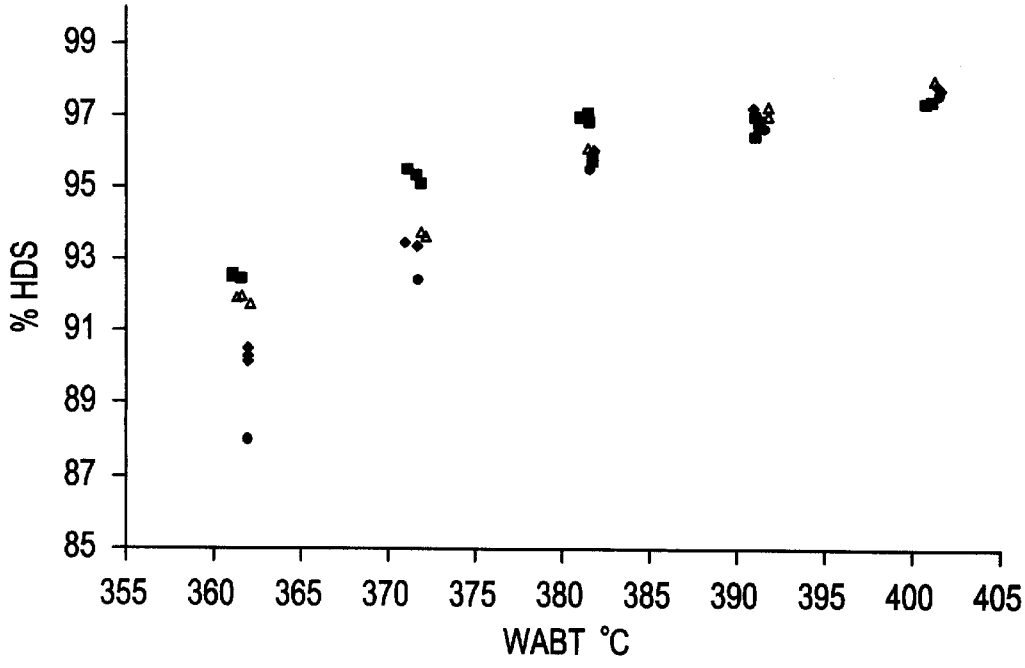
FIG. 3 is a point plot hydrodesulfurization activity versus reactor temperature for multi-component catalyst systems.
Figure 4:
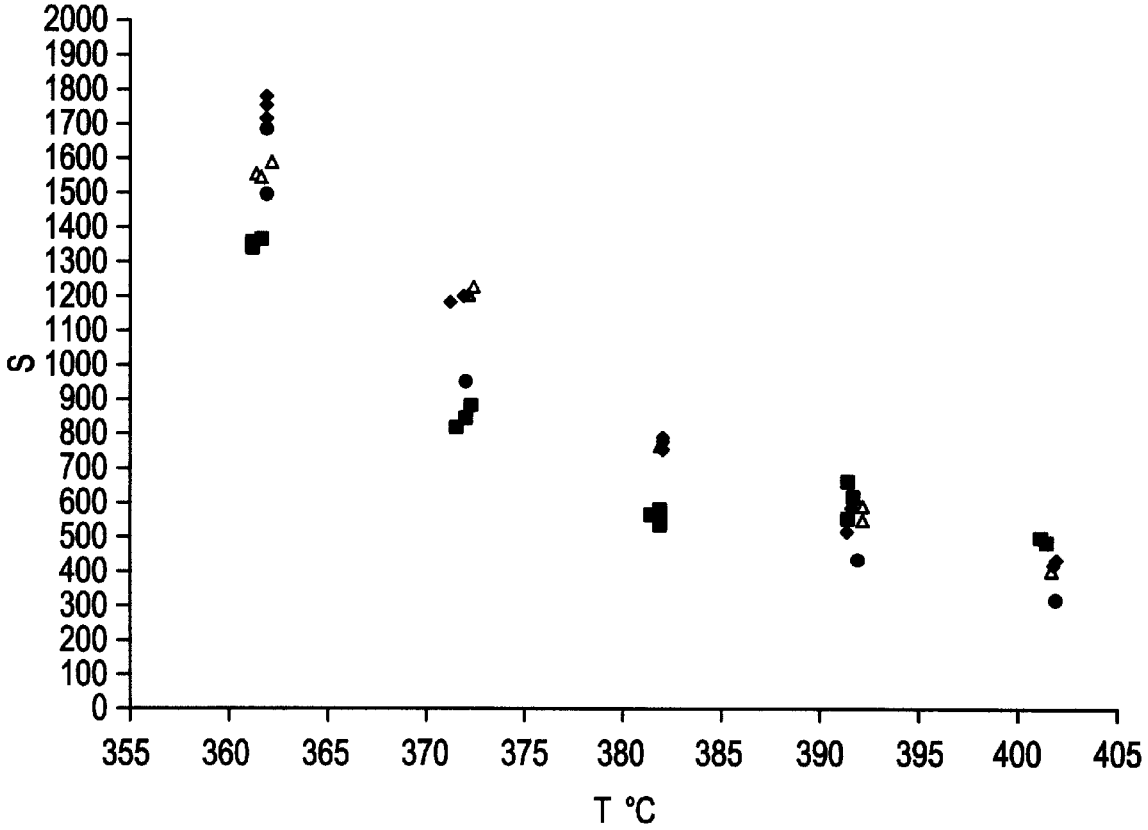
FIG. 4 is a plot of product sulfur content versus reactor temperature for the catalyst systems depicted in FIG. 3.
Figure 5:
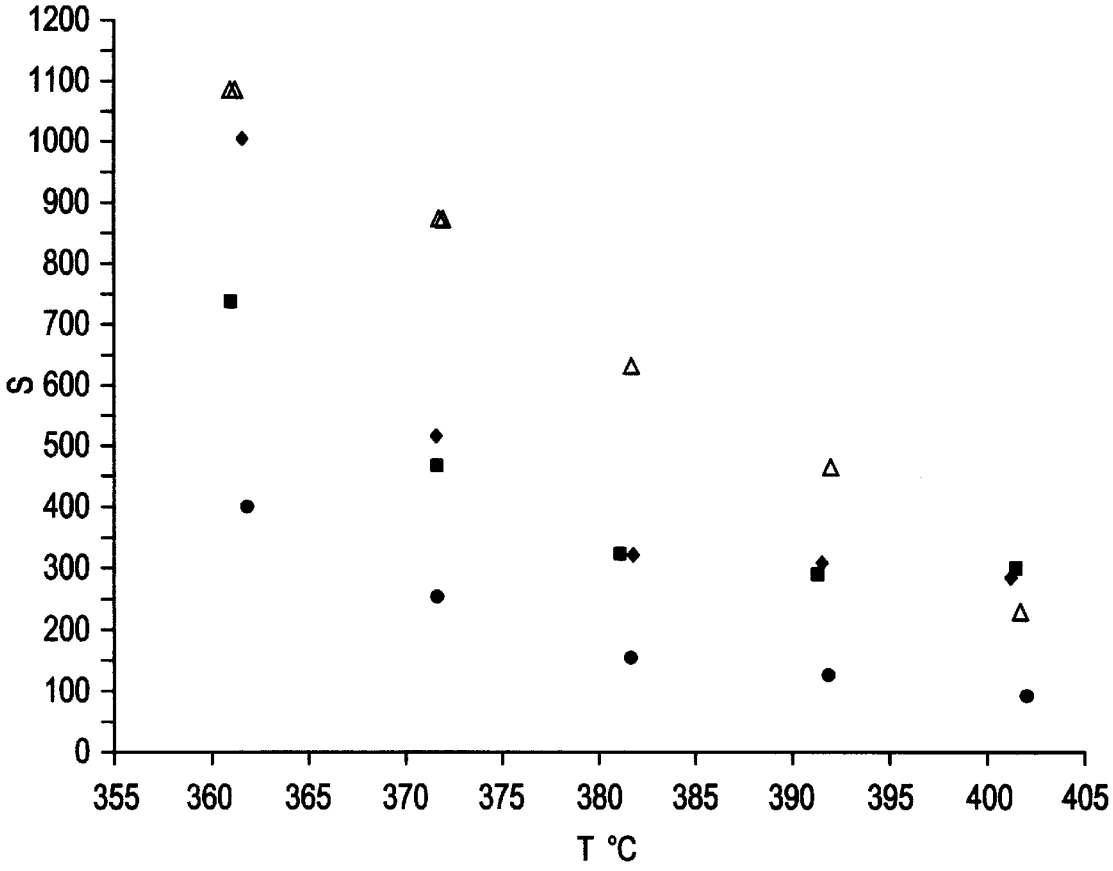
FIG. 5 is a plot of product sulfur in a diesel oil fraction versus as a function of reactor temperature.

Initial desulfurization runs were carried out with catalyst formulations of 100% Catalyst B indicated in FIGS. 3-5 by the legend ♦, a 20/80 blend of Catalyst A/B indicated by legend □, and two runs at a ratio of Catalyst A/B of 40/60 indicated by the legends Δ and ●. In the desulfurization runs, the temperature was increased to the design run temperature at a rate of 1° C. per hour and then held at the run temperature for three days. Hydrogen flow into the reactor was maintained at a partial pressure of hydrogen of 600 psig and at a rate of 1,000 standard milliliters per minute, corresponding at a rate of 1,850 standard cubic feet per barrel at 700° C. The feed was introduced at a rate of 1.81$^{-1}$ LHSV at reaction temperatures of 362° C., 372° C., 382° C., 392° C., and 402° C.

The results of these tests in terms of sulfur removal from the blend of 43 vol. % light cycle oil and 57 vol. % atmospheric gas oil are illustrated in FIGS. 3 and 4. In FIG. 3, percent hydrodesulfurization, HDS, is plotted on the ordinate versus the WABT in degrees C. on the abscissa. In FIG. 4 the sulfur content, S, in parts per million of the product recovered from the reactor is plotted on the ordinate versus the WABT in degrees C. plotted on the abscissa. As can be seen from an examination of FIGS. 3 and 4, the 20/80 Catalyst A/Catalyst B configuration shows substantially better hydrodesulfurization activity over the first three reactor temperatures of 362° C., 372° C., and 382° C. In addition to showing incrementally better hydrodesulfurization than the other catalyst formulations, the system also showed substantial increases in hydrodesulfurization activity throughout the temperature range of 362° C. to 382° C. As indicated by the last two runs at temperatures of 392° C. and 402° C., the hydrodesulfurization activity tended generally to flatten out with further increases in temperature showing little or no increase in hydrodesulfurization activity.

FIG. 5 shows the results of sulfur remaining in a diesel oil fraction having a boiling point range of 400–680° F. Here, the amount of sulfur, S, in parts per million in the product from the reactor is plotted on the ordinate versus the WABT in °C. on the abscissa. As indicated by data points Δ, one 40/60 Catalyst A/B formulation shows an almost linear decrease in sulfur content throughout the test range of 362°–402° C. WABT. The other 40/60 formulation indicated by data points ● showed much lower residual sulfur values throughout the test range, but the last two data points generally flattening out similarly as in the case of the test results shown in FIGS. 3 and 4. Here, the 20/80 Catalyst A/B formulation, indicated by ■, showed results generally similar to the 100% Catalyst A formulation indicated by ♦.

Figure 6:
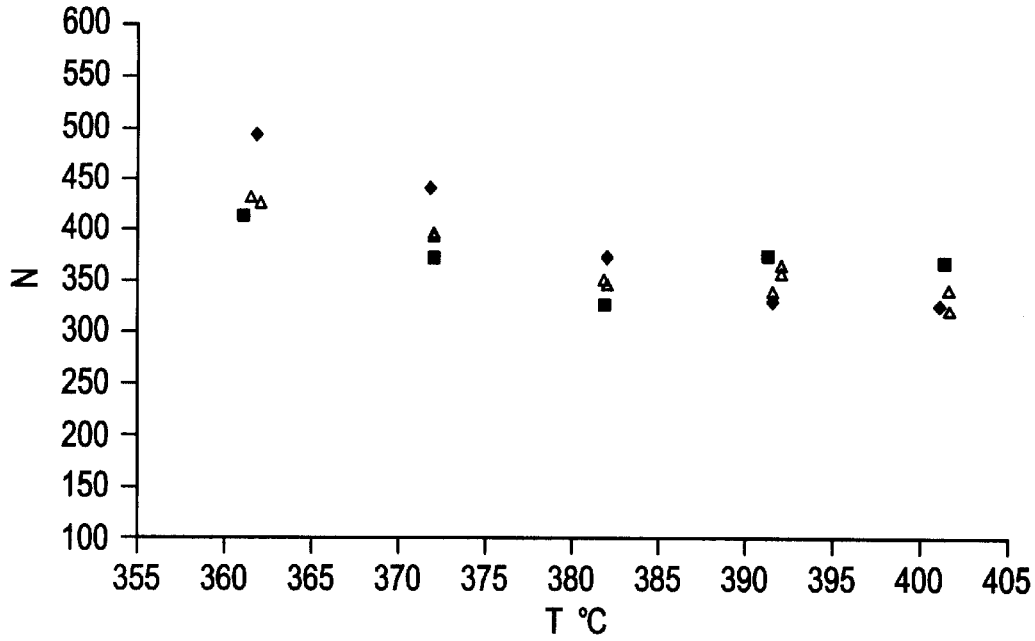
FIG. 6 is a plot of product nitrogen content versus reactor temperature for various single component and multi-component catalyst systems.

FIG. 6 shows the results of the tests in terms of nitrogen removal of the composite blend of 43% light cycle oil and 53% atmospheric gas oil for the 20/80 (■), 40/60 (Δ), and 100% B (♦) catalyst systems. FIG. 6 is a plot of the nitrogen content N in ppm of the product on the ordinate versus WABT in °C. on the abscissa. As indicated, the three catalyst systems, in terms of nitrogen removal, generally conform to the results shown in the sulfur-removal tests with tests run at the lower three temperatures, 362°, 372°, and 382° C., showing progressively lower nitrogen in the product stream, and the tests run at the higher two temperatures of 392° and 402° C. showing the characteristic flattening out of removal as descried above with respect to the desulfurization procedures.

As can be seen from the experimental work described previously, the reactor formulations incorporating a minor amount of Catalyst A, the cobalt molybdenum desulfurization catalysts in the initial stage and a major relative amount of Catalyst B (the cobalt molybdenum catalyst in the subsequent catalyst stage) generally show the best results in terms of sulfur and to some extent in nitrogen removal. This is particularly significant when balanced with the somewhat lower operating temperatures indicative of a higher commercial efficiency of heat utilization. The preferred weighted average bed temperature of the reactor is within the range of 360–390° C., and while the temperature can be increased above this level, there is little or no increase of desulfurization (or denitrogenization) activity associated with the higher temperature and the associated higher operating costs. At temperatures below the 370° C. level, hydrodesulfurization efficiency tends to become marginal with relatively high levels of sulfur left in the hydrotreater product.

Figure 7:
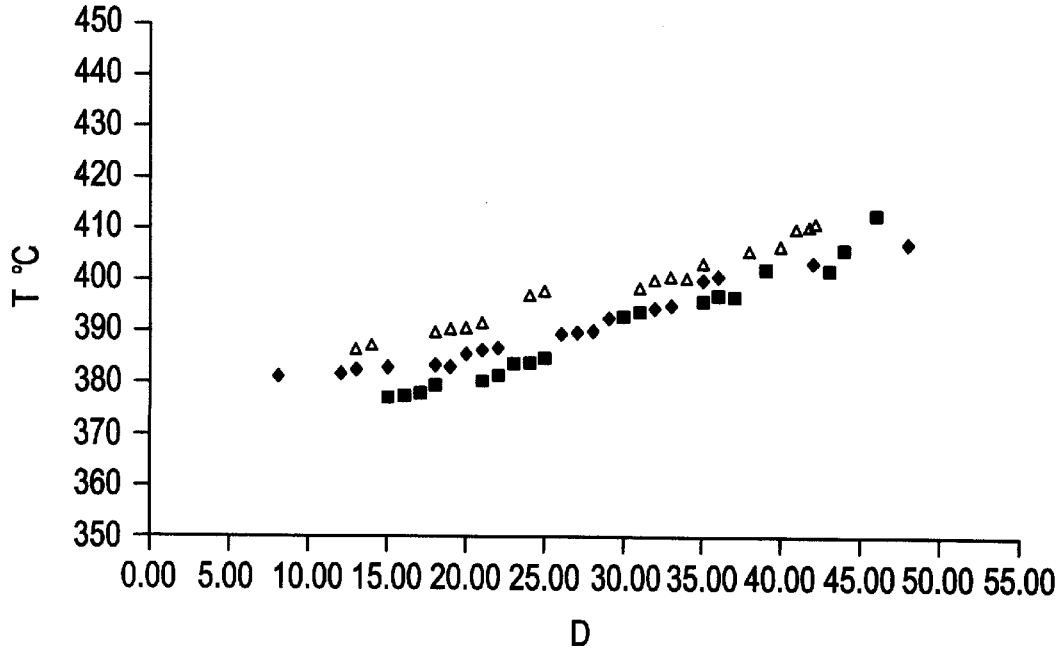
FIG. 7 is a plot of normalized mild hydrocracking temperature versus days on stream for various multi-component and single component catalyst systems.

FIG. 7 shows the normalized temperatures for catalyst systems of 20/80 Catalyst A/B indicated by legend ■, 40/60 Catalyst A/B indicated by legend Δ, and 100% Catalyst B indicated by legend ♦. In FIG. 7 the normalized mild hydrocracking temperature (T) in °C. is plotted on the ordinate versus the days (D) on stream for the pilot plant reactor plotted on the abscissa. In arriving at the normalized temperature, a reaction order of 1.32 was used for all three catalyst systems with a reference sulfur in the product of 500 ppm, a space velocity (LHSV) of 1.81 hr.$^{-1}$, and an energy of activation of 27,000 calories per mole. As can be seen from an examination of the data presented in FIG. 7, the 20/80 system was generally more efficient (as indicated by a lower normalized temperature) than the other two catalyst systems throughout about the first half of a product run. Thereafter, the 20/80 catalyst system was of about equal efficiency with the single component catalyst system and remained somewhat better efficiency throughout the run than for the 40/60 Catalyst A/Catalyst B catalyst system. Thus, the preferred catalyst component of about 20/80 cobalt molybdenum desulfurization/cobalt molybdenum hydrocracking catalyst system showed an advantage not only in terms of desulfurization but also in terms of mild hydrocracking efficiency.

Having described specific embodiments of the present invention, it will be understood that modifications thereof may be suggested to those skilled in the art, and it is intended to cover all such modifications as fall within the scope of the appended claims.

What is claimed:

1. A multistage hydrofining process comprising:

a. supplying a sulfur- and hydrocarbon-containing processing stream to a multistage hydrotreating reactor;

b. within said reactor passing said processing stream into contact with an initial catalyst stage comprising a cobalt molybdenum desulfurization catalyst;

c. thereafter passing said processing stream through an intervening sector of said hydrotreating reactor separating said initial catalyst stage from the hereinafter recited subsequent catalyst stage, said intervening sector containing an inert particulate refractory material;

d. thereafter passing said processing through a subsequent catalyst stage comprising a cobalt molybdenum hydrocracking catalyst, wherein said cobalt molybdenum catalyst in initial catalyst stage comprises from 10–40 wt. % of the composite of the catalysts in said initial and said subsequent catalyst stages and the cobalt molybdenum catalyst in the subsequent catalyst stage comprises from 60–90% of the composite of said cobalt molybdenum desulfurization catalyst and said cobalt molybdenum catalyst; and e. withdrawing an effluent stream having a reduced sulfur content from said hydrotreating reactor.

2. The method of claim 1 wherein said inert particulate material comprises silica particles.

3. The method of claim 2 wherein said silica particles are spheroidal in shape.

4. The method of claim 1 wherein said cobalt molybdenum desulfurization catalyst is supported on an alumina support and said cobalt molybdenum hydrocracking catalyst is supported on a silica/alumina support having a greater acidity than the support of said cobalt molybdenum desulfurization catalyst.

5. The method of claim 4 wherein said cobalt molybdenum desulfurization catalyst in said initial catalyst stage comprises about 10–20% of the total composite amount of said desulfurization catalyst and said hydrocracking catalyst and said cobalt molybdenum hydrocracking catalyst in said subsequent catalyst stage comprises about 80–90% of the total composite amount of said desulfurization catalyst and said hydrocracking catalyst.

6. The method of claim 1 wherein said cobalt molybdenum desulfurization catalyst is presulfided by contact with a sulfur-containing hydrocarbon prior to the supply of said processing to said catalyst.

7. The method of claim 6 wherein said sulfur-containing hydrocarbon is dimethyldisulfide.

8. The method of claim 1 wherein said sulfur-containing feedstock is an atmospheric gas oil fraction.

9. The method of claim 1 wherein said sulfur-containing feedstock comprises a light cycle oil fraction.

10. The method of claim 1 wherein said hydrocarbon feedstock comprises a mixture of an atmospheric gas oil and a light cycle oil fraction.

11.The method of claim 1 wherein the weighted average bed temperature of said reactor is within the range of 360–390° C.

12. The method of claim 11 wherein the weighted average bed temperature of said reactor is within the range of 370–385° C.

13. A multistage hydrofining process comprising:

a. supplying a sulfur- and hydrocarbon-containing processing stream to a multistage hydrotreating reactor;

b. within said reactor passing said processing stream into contact with an initial catalyst stage comprising a minor amount of a cobalt molybdenum desulfurization catalyst;

c. thereafter passing said processing stream through an intervening inert zone within said reactor having a travel path which is less than the travel path of said initial catalyst stage and which contains an inert particulate refractory material having a low thermal capacity;

d. thereafter passing said processing stream through a subsequent catalyst stage comprising a major amount of a cobalt molybdenum hydrocracking catalyst; and e. withdrawing an effluent stream having a reduced sulfur content from said hydrotreating reactor.

14. The process of claim 13 wherein said desulfurization catalyst in said initial catalyst stage comprises about 10–30% of the total composite of said desulfurization catalyst and said hydrocracking catalyst and said hydrocracking catalyst comprises about 70–90% of the total composite amount of said desulfurization catalyst and said hydrocracking catalyst.

15. The method of claim 14 wherein said processing stream has an initial 5% boiling point and a final 95% boiling point within the range of 200–500° C.

16. The method of claim 15 wherein said desulfurization catalyst is supported on an alumina support and said hydrocracking catalyst is supported on a silica/alumina support having a greater acidity than the support of said desulfurization catalyst.

17. The method of claim 16 wherein said inert particulate material comprises silica particles which are spheroidal in shape.

18. The method of claim 16 wherein the weighted average bed temperature of said reactor is within the range of 360–390° C.

19. A multistage hydrofining process comprising:

a. supplying a sulfur- and hydrocarbon-containing processing steam to a multistage hydrotreating reactor;

b. within said reactor passing said processing steam into contact with an initial catalyst stage comprising a minor amount of a cobalt molybdenum desulfurization catalyst, said desulfurization catalyst having a molybdenum content which is greater than the cobalt content;

c. thereafter passing said processing stream through a subsequent catalyst bed comprising a major amount of a cobalt molybdenum hydrocracking catalyst, said hydrocracking catalyst having a molybdenum content which is greater than the cobalt content and the sum of molybdenum and cobalt in said hydrocracking catalyst being less than the sum of molybdenum and cobalt in said desulfurization catalyst; and d. withdrawing an effluent stream having a reduced sulfur content from said hydrotreating reactor.

20. The process of claim 19 wherein said desulfurization catalyst in said initial catalyst stage comprises about 10–30% of the total composite of said desulfurization catalyst and said hydrocracking catalyst and said hydrocracking catalyst comprises about 70–90% of the total composite amount of said desulfurization catalyst and said hydrocracking catalyst.

21. The method of claim 20 wherein said initial catalyst stage and said subsequent catalyst stage is separated by an intervening inert zone within said reactor which has a travel path which is less than the travel path of the initial catalyst stage and which contains an inert particulate refractory material.

22. The method of claim 21 wherein the ratio of molybdenum to cobalt in the initial desulfurization catalyst is about 6:1 and the ratio of molybdenum to cobalt in the hydrocracking catalyst is about 5:1.

* * * * *